US010288287B2

(12) United States Patent
Suzuki et al.

(10) Patent No.: US 10,288,287 B2
(45) Date of Patent: May 14, 2019

(54) COMBUSTION SYSTEM

(71) Applicant: Azbil Corporation, Tokyo (JP)

(72) Inventors: Kayo Suzuki, Tokyo (JP); Yuichi Kumazawa, Tokyo (JP); Tomoya Nakata, Tokyo (JP); Takeshi Nishiyama, Tokyo (JP)

(73) Assignee: Azbil Corporation, Tokyo (JP)

( * ) Notice: Subject to any disclaimer, the term of this patent is extended or adjusted under 35 U.S.C. 154(b) by 203 days.

(21) Appl. No.: 15/417,600

(22) Filed: Jan. 27, 2017

(65) Prior Publication Data

US 2017/0219209 A1 Aug. 3, 2017

(30) Foreign Application Priority Data

Feb. 1, 2016 (JP) ..... 2016-017386

(51) Int. Cl.
*F23N 5/26* (2006.01)

(52) U.S. Cl.
CPC ..... *F23N 5/265* (2013.01); *F23N 2900/00* (2013.01)

(58) Field of Classification Search
CPC ..... F23N 5/265
USPC ..... 431/62, 75, 79, 12
See application file for complete search history.

(56) References Cited

U.S. PATENT DOCUMENTS 5,794,549 A * 8/1998 Carter ..... F23M 11/045 110/185
2008/0138750 A1* 6/2008 Kim ..... F23N 5/242 431/12
2014/0121998 A1* 5/2014 Krull ..... F23N 5/082 702/50

(Continued)

FOREIGN PATENT DOCUMENTS

CN 105021223 A 11/2015
JP 2000-121046 A 4/2000
JP 2011-208921 A 10/2011

OTHER PUBLICATIONS

The State Intellectual Property Office of People's Republic of China, "First Office Action", issued in Chinese Patent Application No. 201710060043.2, which is a counterpart to U.S. Appl. No. 15/417,600, dated Jul. 16, 2018, 16 pages (9 pages of English Translation of Office Action and 7 pages of Office Action).

*Primary Examiner* — Avinash A Savani
(74) *Attorney, Agent, or Firm* — Amster, Rothstein & Ebenstein LLP

(57) ABSTRACT

A combustion control system that collects and accumulates, at predetermined intervals, combustion controlling information including at least a signal indicating an operating state of an ignition device, a signal indicating the supplying state of fuel to a pilot burner, a signal indicating the supplying state of fuel to a main burner, a signal indicating the supplying state of air to the main burner, a flame detection signal indicating the strengths of the flames of the burners (the pilot burner and the main burner), and information (Continued)

indicating presence or absence of the flames determined based on the value of the flame detection signal, and displays the combustion controlling information as trend data of combustion control in a graph in such a form that the relationship between time zones of the combustion sequences from the start of a combustion device to normal combustion and the trend data is understandable.

8 Claims, 6 Drawing Sheets

(56) References Cited

U.S. PATENT DOCUMENTS

2015/0316262 A1 11/2015 Immer et al.

* cited by examiner

G2

| | |
|---|---|
| Ignition Delay Time (S) | 2.4 |
| Number Of Ignitions | 100 |
| Combustion Time | 1000 |
| Operation Time | 2000 |
| | |
| Past Ignition Delay Time (S) | |
| 1 | 2.4 |
| 2 | 2.3 |
| 3 | 1.5 |
| 4 | 2 |
| 5 | 1 |
| 6 | 2.5 |
| | |
| Flame Voltage From Start of Ignition Trial Until Certain Time Elapses | (μA) |
| 1 | 1.9 |
| 2 | 1.8 |
| 3 | 1.5 |
| 4 | 0.5 |
| 5 | 0.3 |

Fig. 3

COMBUSTION SYSTEM

CROSS-REFERENCE TO RELATED APPLICATION

The present application claims the benefit of and priority to Japanese Patent Application No. 2016-017386, filed on Feb. 1, 2016, the entire contents of which are incorporated by reference herein.

TECHNICAL FIELD

The present invention relates to a combustion system that controls the operation of a combustion device and monitors the control state of the operation of the combustion device.

BACKGROUND

FIG. 6 illustrates an example of a combustion system using a combustion controlling device for controlling the operation of a combustion device (see, for example, PTL 1). This combustion system 200 includes combustion equipment 1, a combustion controlling device 2 (2B), a fuel flow channel 3, and an air flow channel 4.

The combustion equipment 1 includes a combustion chamber 5, a main burner 6 for heating the inside of the combustion chamber 5, a pilot burner 7 for igniting the main burner 6, an ignition device (IG) 8 for igniting the pilot burner 7, a flame detector 9 for detecting the strengths of flames of the burners (the pilot burner 7 and the main burner 6), and a temperature sensor 10 for detecting the temperature in the combustion chamber 5.

The fuel flow channel 3 is a flow channel through which fuel is supplied to the combustion equipment 1 and includes a main flow channel 3*a* to which fuel is supplied from the outside and a first flow channel 3*b* and a second flow channel 3*c* branched from the main flow channel 3*a*. The first flow channel 3*b* is connected to the main burner 6 and the second flow channel 3*c* is connected to the pilot burner 7. In addition, the main flow channel 3*a* is provided with a gas pressure switch 15, the first flow channel 3*b* is provided with safety shutoff valves 11 and 12, and the second flow channel 3*c* is provided with safety shutoff valves 13 and 14.

One end of the air flow channel 4 is connected to a blower 16 and the other end is connected to the first flow channel 3*b*. Air discharged from the blower 16 is supplied to the main burner 6 together with fuel (gas) via the first flow channel 3*b*. In addition, the air flow channel 4 is provided with a wind pressure switch (air flow switch) 17 and a damper 18.

The combustion controlling device 2 (2B) receives a flame detection signal (signal for indicating the strengths of flames of the burners) from the flame detector 9 and a temperature detection signal from the temperature sensor 10 and outputs control signals to the safety shutoff valves 11 to 14, the ignition device 8, the blower 16, the damper 18, and the like. This controls the operation of a combustion device 19 surrounded by the dot-and-dash line in the drawing.

Depending on the type of the combustion device 19, the flame of the pilot burner 7 is extinguished after ignition of the main burner 6 or the flame of the pilot burner 7 is kept even after ignition of the main burner 6. In the former type, the flame detector 9 first detects the strength of the flame of the pilot burner 7 and then detects the strength of the flame of the main burner 6. In the latter type, the strengths of the flames of the pilot burner 7 and the main burner 6 are detected in a combined manner. Another type has only the main burner 6 without having the pilot burner 7. In this specification, the pilot burner 7 and the main burner 6 are called burners and the flame detected by the flame detector 9 is called the flames of the burners. FIG. 6 illustrates the type that keeps the flame of the pilot burner 7 even after ignition of the main burner 6 and the flame detector 9 detects the flames of the pilot burner 7 and the main burner 6 as the flames of the burners.

In addition, the combustion controlling device 2 (2B) monitors the states of the gas pressure switch 15, the wind pressure switch 17, the flame detector 9, and the like and, when detecting an abnormality, closes the safety shutoff valves 11 to 14 to interrupt the supply of the fuel to the burners.

In the combustion system 200, the operational order from the start of the combustion device 19 to normal combustion is defined as a combustion sequence. For example, as the operational order from the start of the combustion device 19 to normal combustion, the time zones of combustion sequences such as "start check", "prepurge", "ignition waiting", "ignition trial", "pilot trial", "main trial", and "normal combustion" are determined.

With respect to such a combustion system, PTL 2 discloses a technique for transmitting, from the combustion controlling device to a remote monitoring device operated by a maintenance person, combustion controlling information from a prescribed time before the occurrence of an abnormality to the occurrence of the abnormality as trend data of combustion control and displaying the trend data in a graph on a screen (monitoring screen) of the remote monitoring device. The maintenance person can study the control state of the operation of the combustion device at the occurrence of an alarm in detail by checking the trend data of combustion control displayed in a graph and can analyze the cause of the alarm in detail.

CITATION LIST

Patent Literature

[PTL 1] JP-A-2011-208921
[PTL 2] JP-A-2000-121046

SUMMARY

However, the technique described in PTL 2 can reference the trend data of combustion control only at the occurrence of an alarm. That is, the trend data of combustion control during normal operation cannot be referenced, so the trend data of combustion control cannot be used for maintenance such as early detection of an abnormality.

The invention addresses such a problem with an object of providing a combustion system capable of using trend data of combustion control for maintenance.

According to the invention, to achieve such an object, there is provided a combustion system (100) for controlling an operation of a combustion device (19) having at least an ignition device (8) and burners (6 and 7) and monitoring a control state of the combustion device (19), the combustion system (100) including a combustion controlling information collecting portion (2-1) collecting, at predetermined intervals, combustion controlling information including at least a signal (S4) indicating an operating state of the ignition device (8), signals (S5 and S6) indicating supplying states of fuel to the burners (6 and 7), a signal (S2) indicating a supplying state of air to the burners (6 and 7), a flame detection signal (S7) indicating strengths of flames of the burners (6 and 7), and information (S8) indicating presence or absence of the flames determined based on a value of the flame detection signal (S7), a combustion controlling information accumulating portion (2-2) accumulating, on a time-series basis, the combustion controlling information collected by the combustion controlling information collecting portion (2-1), an outputting portion (2-3) outputting, as trend data of combustion control, the combustion controlling information accumulated in the combustion controlling information accumulating portion (2-2) together with information (S0) indicating time zones (J1 to J7) of combustion sequences from a start of the combustion device (19) to normal combustion, and a displaying portion (20-1) displaying the trend data of combustion control output from the outputting portion (2-3) in such a form that a relationship between the time zones (J1 to J7) of the combustion sequences from the start of the combustion device (19) to normal combustion and the trend data is understandable.

In the invention, the combustion controlling information collecting portion (2-1) collects, at predetermined intervals, the combustion controlling information including at least the signal (S4) indicating the operating state of the ignition device (8), the signals (S5 and S6) indicating the supplying states of fuel to the burners (6 and 7), the signal (S2) indicating the supplying state of air to the burners (6 and 7), the flame detection signal (S7) indicating the strengths of flames of the burners (6 and 7), and the information (S8) indicating the presence or absence of the flames determined based on the value of the flame detection signal (S7).

The collected combustion controlling information is accumulated in the combustion controlling information accumulating portion (2-2) on a time-series basis. The outputting portion (2-3) outputs, as the trend data of combustion control, the combustion controlling information accumulated in the combustion controlling information accumulating portion (2-2) together with the information (SO) indicating the time zones (J1 to J7) of combustion sequences from the start of the combustion device (19) to normal combustion. The displaying portion (20-1) presents the trend data of combustion control output from the outputting portion (2-3) in such a form that the relationship between the time zones (J1 to J7) of the combustion sequences from the start of the combustion device (19) to normal combustion and the trend data is understandable.

For example, if the combustion controlling information accumulated in the combustion controlling information accumulating portion (2-2) is called every day as the trend data of combustion control and the called trend data of combustion control is displayed in a graph on the screen in such a form that the relationship between the time zones (J1 to J7) of the combustion sequences from the start of the combustion device (19) to normal combustion and the trend data is understandable, changes in the combustion controlling information from the start of the combustion device (19) to normal combustion can be checked for each combustion sequence and the trend data of combustion control can be used for maintenance such as early detection of an abnormality.

In the above description, the components in the drawings corresponding to components of the invention are indicated by reference numerals enclosed in parentheses.

According to the invention, the combustion controlling information including at least the signal indicating the operating state of the ignition device, the signals indicating the supplying states of fuel to the burners, the signal indicating the supplying state of air to the burners, the flame detection signal indicating the strengths of flames of the burners, and the information indicating the presence or absence of the flames determined based on the value of the flame detection signal is collected at predetermined intervals, the collected combustion controlling information is accumulated in the combustion controlling information accumulating portion on a time-series basis, the combustion controlling information accumulated in the combustion controlling information accumulating portion is output as the trend data of combustion control together with the information indicating the time zones of the combustion sequences from the start of the combustion device to normal combustion, and the output trend data of combustion control is presented in such a form that the relationship between the time zones of the combustion sequences from the start of the combustion device to normal combustion and the trend data is understandable, so changes in the combustion controlling information from the start of the combustion device to normal combustion can be checked for each combustion sequence and the trend data of combustion control can be used for maintenance such as early detection of an abnormality.

BRIEF DESCRIPTION OF THE DRAWINGS

FIG. 3 illustrates a table displayed together with a graph of the trend data of combustion control.

DETAILED DESCRIPTION

Figure 1:
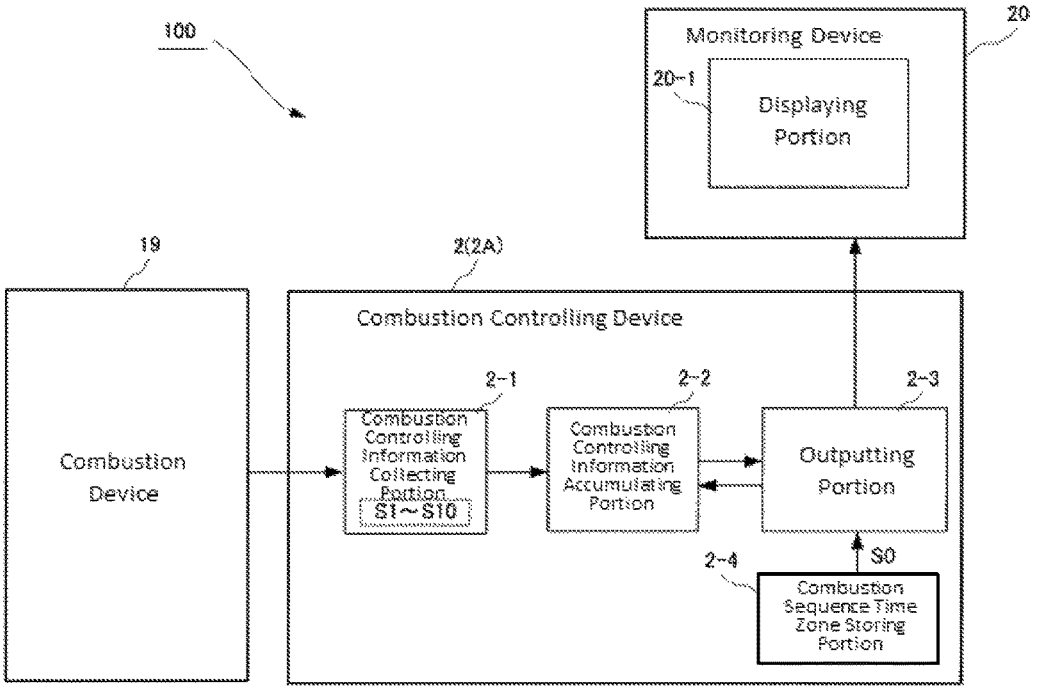
FIG. 1 illustrates the main part of a combustion system according to an embodiment of the invention.

An embodiment of the invention will be described in detail below with reference to the drawings. FIG. 1 illustrates the main part of a combustion system 100 according to the invention.

Figure 6:
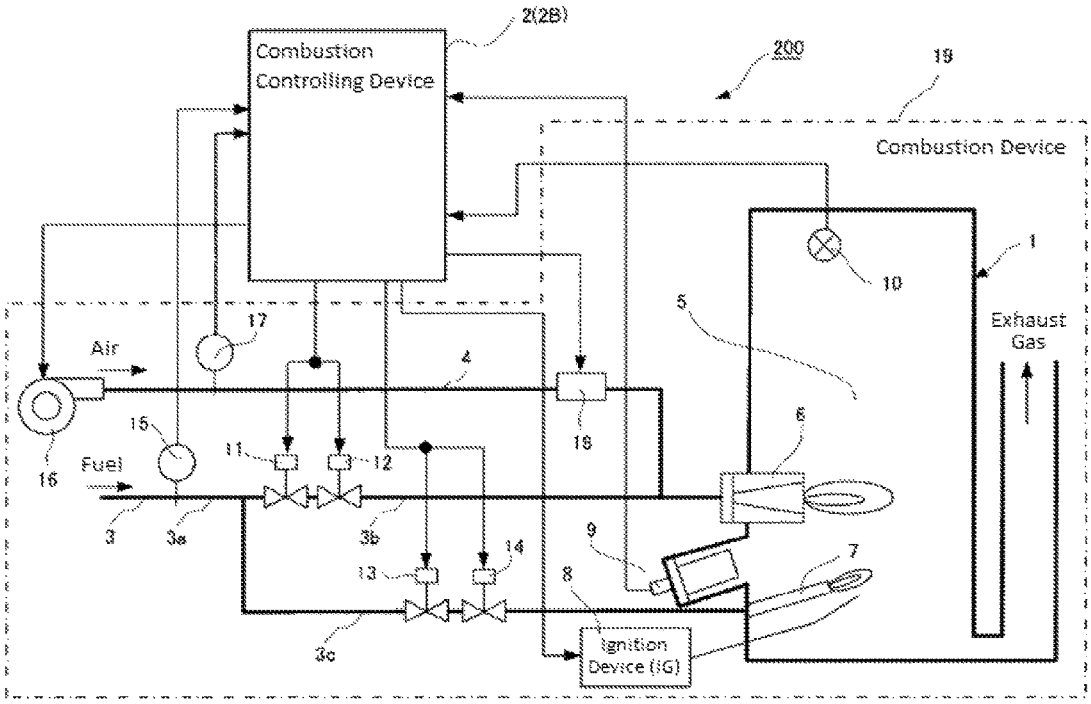
Fig. 6 RELATED ART
FIG. 6 illustrates an example of a combustion system including a combustion controlling device controlling the operation of a combustion device.

The basic structure of the combustion system 100 is the same as in the conventional combustion system 200 illustrated in FIG. 6 except that "the function of collecting combustion controlling information", "the function of accumulating the collected combustion controlling information", and "the function of outputting the accumulated combustion controlling information as the trend data of combustion control" have been added to a combustion controlling device 2 (2A). In addition, the combustion system 100 transmits the trend data of combustion control output from the combustion controlling device 2 (2A) to a monitoring device 20 and displays the trend data in a graph on a screen (monitoring screen) of the monitoring device 20.

In the combustion system 100, the combustion controlling device 2 (2A) is achieved by hardware including processors and memory devices and programs achieving various functions in cooperation with such hardware and the combustion controlling device 2 (2A) has a combustion controlling information collecting portion 2-1, a combustion controlling information accumulating portion 2-2, an outputting portion 2-3, and a combustion sequence time zone storing portion 2-4 as the feature portions specific to the embodiment.

FIG. 1 selectively illustrates only the feature portions specific to the embodiment added to the combustion controlling device 2 (2A). In addition, the structure illustrated in FIG. 6 is also used as the basic structure of the combustion device 19.

In the combustion controlling device 2 (2A), the combustion controlling information collecting portion 2-1 collects the combustion controlling information at predetermined intervals (for example, 0.1 seconds). In the embodiment, an input/start signal S1 indicating the operational state the combustion device 19, an air flow switch signal S2 indicating the supplying state of air to the main burner 6, an output/blower signal S3 indicating the operating state of the blower 16, a signal S4 (input/IG relay feedback) indicating the operating state of the ignition device 8, a signal S5 (input/PV relay feedback) indicating the supplying state of fuel to the pilot burner 7, a signal S6 (input/MV relay feedback) indicating the supplying state of fuel to the main burner 6, a flame detection signal S7 indicating the strengths of flames of the burners (the pilot burner 7 and the main burner 6), and the like are collected as the combustion controlling information at intervals of, for example, 0.1 seconds.

The combustion controlling device 2 (2A) determines presence or absence of flame, non-ignition, flame interruption (flame loss), and the like based on the value of the flame detection signal S7. The combustion controlling information collected by the combustion controlling information collecting portion 2-1 also includes information S8 indicating presence or absence of flame determined by the combustion controlling device 2 (2A), information S9 indicating non-ignition, information S10 indicating flame interruption, and the like.

The combustion controlling information collected by the combustion controlling information collecting portion 2-1 is accumulated in the combustion controlling information accumulating portion 2-2 on a time-series basis. The combustion sequence time zone storing portion 2-4 stores information SO indicating the time zones of the combustion sequences from the start of the combustion device 19 performed by the combustion controlling device 2 (2A) to normal combustion.

The outputting portion 2-3 reads, as the trend data of combustion control, the combustion controlling information accumulated in the combustion controlling information accumulating portion 2-2 and outputs the read trend data of combustion control to the monitoring device 20 together with the information S0 indicating the time zones of the combustion sequences stored in the combustion sequence time zone storing portion 2-4.

The monitoring device 20 has a displaying portion 20-1 having a display unit in which the monitoring screen is displayed and the monitoring device 20 displays, in a graph on the monitoring screen of the displaying portion 20-1, the trend data of combustion control from the combustion controlling device 2 (2A) in such a form that the relationship between the time zones of the combustion sequences and the trend data is understandable.

Figure 2:
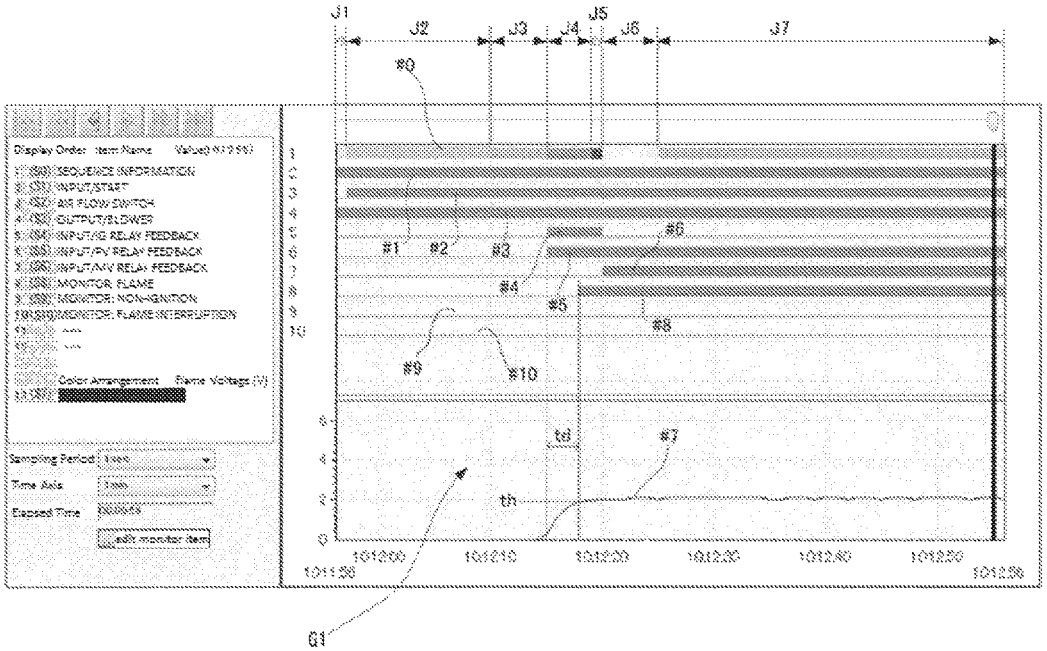
FIG. 2 illustrates an example of displaying trend data of combustion control in the combustion system.

FIG. 2 illustrates an example of displaying the trend data of combustion control. In this example, the graph representing the time zones of combustion sequences from the start of the combustion device 19 to normal combustion is indicated by #0 and the time zones of the combustion sequences in the graph #0 are represented in different shades.

In the graph #0, J1 indicates the time zone for "start check", J2 indicates the time zone for "prepurge", J3 indicates the time zone for "ignition waiting", J4 indicates the time zone for "ignition trial", J5 indicates the time zone for "pilot trial", J6 indicates the time zone for "main trial", and J7 indicates the time zone for "normal combustion". These time zones J1 to J7 are obtained from the information SO indicating the time zones of the combustion sequences.

In addition, to clarify the relationship with the time zones J1 to J7 of the combustion sequences in the graph #0, a graph #1 indicates the operational state of the combustion device 19 obtained from the input/start signal S1, a graph #2 indicates the supplying state of air to the main burner 6 obtained from the air flow switch signal S2, and a graph #3 indicates the operating state of the blower 16 obtained from the output/blower signal S3 with their time axes aligned.

In addition, a graph #4 indicates the operating state of the ignition device 8 obtained from the signal S4, a graph #5 indicates the supplying state of fuel to the pilot burner 7 obtained from the signal S5, a graph #6 indicates the supplying state of fuel to the main burner 6 obtained from the signal S6, a graph #7 indicates the strengths of the flames of the burner obtained from the flame detection signal S7, and a graph #8 indicates the presence or absence of the flame obtained from the information S8 indicating presence or absence of flame.

In this example, non-ignition or flame interruption does not occur and a graph #9 indicating non-ignition obtained from the information S9 indicating non-ignition and a graph #10 indicating flame interruption obtained from the information S10 indicating flame interruption are not displayed. In addition, in the graph #7 indicating the strengths of the flames of the burners, changes in the value (flame voltage) of the flame detection signal S7 are represented as a waveform.

In addition, in the embodiment, a table G2 (FIG. 3) is displayed together with a graph G1 of the trend data of combustion control illustrated in FIG. 2 and a time td from when the ignition device 8 starts until the value of the flame detection signal S7 exceeds a predetermined value th is indicated as values of an ignition delay time in the table G2.

In addition, the table G2 illustrates, as values, a number of ignitions, a combustion time, an operation time, the history of several ignition delay times (past ignition delay times), the value (flame voltage from the start of ignition trial until a certain time elapses) of the flame detection signal S7 a predetermined time after the ignition device 8 starts thus far in the combustion device 19.

The information in the table G2 is requested by the combustion controlling device 2 (2A), stored in the internal memory of the combustion controlling device 2 (2A), and transmitted to the monitoring device 20 together with the trend data of combustion control from the outputting portion 2-3.

In the combustion system 100, the user displays, for example, the graph G1 or the table G2 on the screen (monitoring screen) of the monitoring device 20 everyday. Accordingly, changes in the combustion controlling information from the start of the combustion device 19 to normal combustion can be checked for each combustion sequence and the information indicated in the graph G1 or the table G2 can be used for maintenance such as early detection of an abnormality.

That is, the graph G1 can be used to check the load state and variations in the flame voltage for each of combustion sequences from the start of the combustion device 19 to normal combustion on a time-series basis and forecasts, such as burning uneasily or the unstable flame state, can be used for maintenance.

In addition, the table G2 can be used to check the ignition delay time, the number of ignitions, the combustion time, the operation time, changes in the ignition delay time, changes in the flame voltage from the start of ignition trial until a certain time elapses, and the like, so the table G2 can be used for maintenance, such as the replacement time of components or the prediction of a failure in the device.

Figure 4:
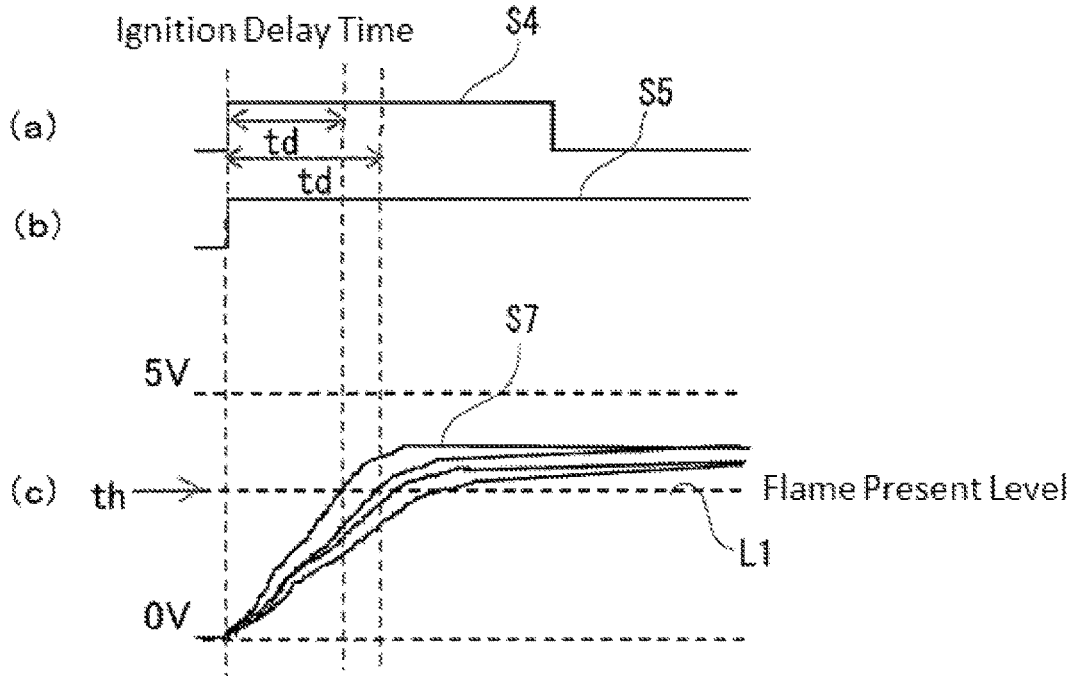
FIG. 4 illustrates an example of indicating the history of several waveforms indicating changes in a value (flame voltage) of a flame detection signal while being superimposed.

Although the history of the ignition delay time is indicated in the table G2 as values in the embodiment described above, the history of several waveforms indicating changes in the value (flame voltage) of the flame detection signal S7 may be displayed while being superimposed as illustrated in FIG. 4(*c*). FIG. 4(*a*) illustrates changes in the signal S4 indicating the operating state of the ignition device 8 and FIG. 4(*b*) illustrates changes in the signal S5 indicating the supplying state of fuel to the pilot burner 7. In addition, the waveform indicating changes in the value of the flame detection signal S7 is indicated together with a line L1 indicating the predetermined value th as a flame level.

As described above, by displaying the history of several waveforms indicating changes in the value of the flame detection signal S7 together with the line L1 indicating the predetermined value th by superposing them, changes in the time (ignition delay time) td after the ignition device 8 operates until the value of the flame detection signal S7 exceeds the predetermined value th can be grasped as a length instead of values. In this example, the ignition delay time td gradually increases and, based on the changes in the length of the ignition delay time td, the current situation can be grasped sensuously.

In addition, although changes in the combustion controlling information are displayed in a graph in the entire section of the time zones J1 to J7 of combustion sequences from the start of the combustion device 19 to normal combustion in the embodiment described above, the time zone J2 of, for example, "prepurge" is long, so an intermediate portion within the time zone J2 of "prepurge" may be omitted.

In addition, although the monitoring device 20 is provided separately from the combustion controlling device 2 (2A) and the trend data of combustion control is displayed in a graph on the screen (monitoring screen) of the monitoring device 20 in such a form that the relationship between the time zones of the combustion sequences and the trend data is understandable in the above embodiment, a displaying portion for displaying a monitoring screen may be provided in the combustion controlling device 2 (2A) and the trend data may be displayed in a graph on the monitoring screen of the displaying portion in such a form that the relationship between the time zones of the combustion sequences and the trend data is understandable.

Figure 5:
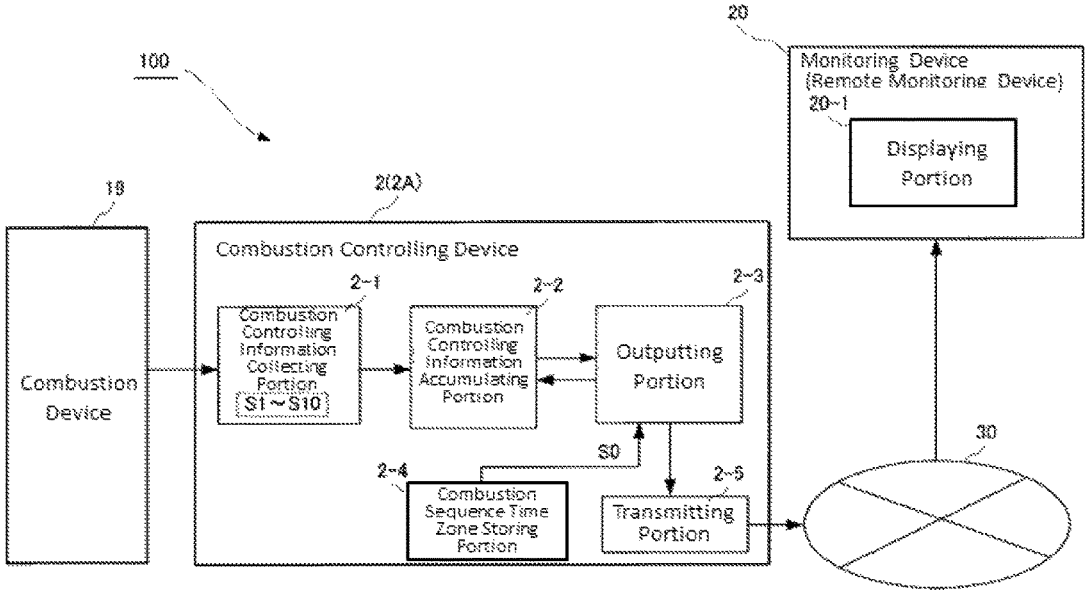
FIG. 5 illustrates an example in which the trend data of combustion control is transmitted to a monitoring device (remote monitoring device) in a remote site connected via the Internet.

In addition, as illustrated in FIG. 5, a transmitting portion 2-5 may be provided in the combustion controlling device 2 (2A) and the trend data of combustion control and the information S0 indicating the time zones of the combustion sequences may be transmitted from the transmitting portion 2-5 to a remote monitoring device (remote monitoring device) 20 via the Internet 30 so as to display the trend data of combustion control on the screen (monitoring screen) of the monitoring device 20 in such a form that the relationship between the time zones of the combustion sequences and the trend data is understandable.

In addition, although the trend data of combustion control from the combustion controlling device 2 (2A) is displayed on the screen (monitoring screen) of the monitoring device 20 in such a graph form that the relationship between the time zones of the combustion sequences and the trend data is understandable in the above embodiment, the trend data may be printed on a sheet by a printer instead of being displayed on the monitoring screen.

In addition, the monitoring device 20 may be a personal computer and information from the combustion controlling device 2 (2A) may be stored in the personal computer. In addition, it is possible to determine what is happening currently in the combustion device 19 by storing the data obtained during normal combustion in the personal computer and comparing this data with the data obtained during occurrence of an abnormality.

[Expansion of Embodiment]

Although the invention has been described with reference to the embodiment above, the invention is not limited to the above embodiment. Various changes understandable to those skilled in the art can be made to the structure and details of the invention within the scope of the invention.

DESCRIPTION OF REFERENCE NUMERALS AND SIGNS

1: combustion equipment; 2 (2A), 2 (2B): combustion controlling device; 2-1: combustion controlling information collecting portion; 2-2: combustion controlling information accumulating portion; 2-3: outputting portion; 2-4: combustion sequence time zone storing portion; 2-5: transmitting portion; 3: fuel flow channel; 4: air flow channel; 5: combustion chamber; 6: main burner; 7: pilot burner; 8: ignition device; 9: flame detector; 10: temperature sensor; 11 to 14: safety shutoff valve; 15: gas pressure switch; 16: blower; 17: wind pressure switch (air flow switch); 18: damper; 19: combustion device; 20: monitoring device; 20-1: displaying portion; 30: Internet; 100, 200: combustion system

The invention claimed is:

1. A combustion system for controlling an operation of a combustion device having at least an ignition device and burners, and for monitoring a control state of an operation of the combustion device, the combustion system comprising:

one or more memory devices; and one or more processors, coupled to the one or more memory devices, that execute one or more programmed instructions stored on the one or more memory devices to embody:

a combustion controlling information collecting portion collecting, at predetermined intervals, combustion controlling information including at least a signal indicating an operating state of the ignition device, signals indicating supplying states of fuel to the burners, a signal indicating a supplying state of air to the burners, a flame detection signal indicating strengths of flames of the burners, and information indicating presence or absence of the flames determined based on a value of the flame detection signal;

a combustion controlling information accumulating portion accumulating, on a time-series basis, the combustion controlling information collected by the combustion controlling information collecting portion;

an outputting portion outputting, as trend data of combustion control, the combustion controlling information accumulated in the combustion controlling information accumulating portion together with information indicating time zones of combustion sequences from a start of the combustion device to normal combustion; and a displaying portion displaying the trend data of combustion control output from the outputting portion in such a form that a relationship between the time zones of the combustion sequences from the start of the combustion device to normal combustion and the trend data is understandable, wherein the displaying portion further presents a time from when the ignition device operates until a value of the flame detection signal exceeds a predetermined value as an ignition delay time.

2. A combustion system for controlling an operation of a combustion device having at least an ignition device and burners, and for monitoring a control state of an operation of the combustion device, the combustion system comprising:

one or more memory devices;

one or more processors, coupled to the one or more memory devices, that execute one or more programmed instructions stored on the one or more memory devices to embody:

a combustion controlling information collecting portion collecting, at predetermined intervals, combustion controlling information including at least a signal indicating an operating state of the ignition device, signals indicating supplying states of fuel to the burners, a signal indicating a supplying state of air to the burners, a flame detection signal indicating strengths of flames of the burners, and information indicating presence or absence of the flames determined based on a value of the flame detection signal;

a combustion controlling information accumulating portion accumulating, on a time-series basis, the combustion controlling information collected by the combustion controlling information collecting portion;

an outputting portion outputting, as trend data of combustion control, the combustion controlling information accumulated in the combustion controlling information accumulating portion together with information indicating time zones of combustion sequences from a start of the combustion device to normal combustion; and a displaying portion displaying the trend data of combustion control output from the outputting portion in such a form that a relationship between the time zones of the combustion sequences from the start of the combustion device to normal combustion and the trend data is understandable;

a combustion controlling device controlling the operation of the combustion device; and a monitoring device monitoring the operation of the combustion device, wherein the combustion controlling device includes the combustion controlling information collecting portion, the combustion controlling information accumulating portion, and the outputting portion and the monitoring device includes the displaying portion.

3. A combustion system for controlling an operation of a combustion device having at least an ignition device and burners, and for monitoring a control state of an operation of the combustion device, the combustion system comprising:

one or more memory devices;

one or more processors, coupled to the one or more memory devices, that execute one or more programmed instructions stored on the one or more memory devices to embody:

a combustion controlling information collecting portion collecting, at predetermined intervals, combustion controlling information including at least a signal indicating an operating state of the ignition device, signals indicating supplying states of fuel to the burners, a signal indicating a supplying state of air to the burners, a flame detection signal indicating strengths of flames of the burners, and information indicating presence or absence of the flames determined based on a value of the flame detection signal;

a combustion controlling information accumulating portion accumulating, on a time-series basis, the combustion controlling information collected by the combustion controlling information collecting portion;

an outputting portion outputting, as trend data of combustion control, the combustion controlling information accumulated in the combustion controlling information accumulating portion together with information indicating time zones of combustion sequences from a start of the combustion device to normal combustion; and a displaying portion displaying the trend data of combustion control output from the outputting portion in such a form that a relationship between the time zones of the combustion sequences from the start of the combustion device to normal combustion and the trend data is understandable; and a combustion controlling device controlling the operation of the combustion device, wherein the combustion controlling device includes the combustion controlling information collecting portion, the combustion controlling information accumulating portion, the outputting portion, and the displaying portion.

4. The combustion system according to claim 1, wherein the displaying portion assumes a time from when the ignition device operates until a value of the flame detection signal exceeds a predetermined value to be an ignition delay time and further presents history of several ignition delay times.

5. The combustion system according to claim 1, wherein the displaying portion further presents a number of ignitions, a combustion time, and an operation time thus far in the combustion device.

6. The combustion system according to claim 1, wherein the displaying portion further presents a value of the flame detection signal a predetermined time after the ignition device operates.

7. The combustion system according to claim 1, wherein the displaying portion assumes a time from when the ignition device operates until a value of the flame detection signal exceeds a predetermined value to be an ignition delay time and further presents history of several waveforms indicating changes in the value of the flame detection signal while the waveforms are superimposed on a line indicating the predetermined value.

8. The combustion system according to claim 1, wherein the displaying portion displays the trend data of combustion control in a graph on a screen.

* * * * *